United States Patent [19]

Albin

[11] Patent Number: 4,763,825

[45] Date of Patent: Aug. 16, 1988

[54] FRAMING TOOL

[76] Inventor: Stephen D. Albin, 797 Manor Way, Los Altos, Calif. 94022

[21] Appl. No.: 84,378

[22] Filed: Aug. 11, 1987

[51] Int. Cl.[4] ..... B25C 7/00

[52] U.S. Cl. ..... 227/142; 227/143

[58] Field of Search ..... 227/140, 141, 142, 143, 227/144, 146, 147, 148, 120

[56] References Cited

U.S. PATENT DOCUMENTS

| | | | |
|---|---|---|---|
| 1,406,974 | 2/1922 | Chamberlain | 227/141 |
| 1,633,533 | 6/1927 | Kern | 227/144 X |
| 2,680,245 | 6/1954 | Marano | 227/120 |
| 3,231,169 | 1/1966 | Jorgensen | 227/143 |
| 3,675,839 | 7/1972 | Thomas | 227/140 |

*Primary Examiner*—Paul A. Bell

*Attorney, Agent, or Firm*—Flehr, Hohbach, Test, Albritton & Herbert

[57] ABSTRACT

A framing tool is disclosed for applying fasteners to the interior perimeter of a frame to mount a picture or the like. The framing tool includes a conventional fastener applying instrument that includes a driving means for propelling a fastener into the frame and a storage means for storing a plurality of fasteners and delivering the fasteners to the actuator means. An actuator assembly is provided for both positioning and triggering the fastener applying instrument. The actuator assembly includes a rod that communicates with the driving means and is slideably coupled to a sleeve. A backing plate is selectively secured to the sleeve by a clamping arrangement to engage the exterior perimeter of the frame and position the driving means. A trigger is provided that moves the rod relative to the sleeve in order to actuate the driving means.

11 Claims, 2 Drawing Sheets

FRAMING TOOL

BACKGROUND OF THE INVENTION

The present invention relates generally to fastener applying instruments. More particular, the present invention discloses a tool adapted to drive staples, glazier points, brads and other fasteners to the interior perimeter of a frame to mount a picture, photo, window or the like within a frame.

When placing pictures, photographs, window or other flat articles within a frame, it is customary to lay the article within a recess built into the frame. Utilizing picture framing as an example, it is common to loosely lay a glass plate in front of the picture and a cardboard backing behind the picture, to secure it in place, as well as to protect it from the elements. Typically fasteners in the form of glazier points, brads and/or staples are placed along the perimeter of the recess behind the cardboard backing in order to secure the mounted picture in place. Traditionally, these fasteners were applied by hand, which is a laborious process, particularly when frequently repeated as required in the environment of a framing shop. More recently, fastening implements such as staplers, glazier point drivers and nailing guns have been used to set the fasteners. However, due to such factors as operator fatigue and gun recoil, repeated uses of such devices tends to lead to poorly positioned and improperly driven fasteners since it is difficult to control the depth of the fastener's penetration. Thus, fasteners applied with such devices often are driven much too deep, thereby becoming useless or are not driven deep enough thereby requiring the framer to manually drive them the rest of the way. Additionally, continued use of such devices can be fatiguing as well.

Therefore, there is a need for a framing tool capable of consistently driving fasteners to a selected depth, that engages the frame and may be rested on the item being framed in order to reduce user exertion.

SUMMARY OF THE INVENTION

It is a primary objective of the invention to provide a picture framing tool adapted for driving fasteners into the interior perimeter of a frame to secure the framed article in place.

Another object of the present invention is to provide a picture framing tool capable of consistently driving fasteners to approximately the same height above the inner perimeter of the frame.

Another object of the present invention is to provide an actuator assembly that may be adapted to work with existing fastener applying instruments to control the depth of fastener penetration.

To achieve the foregoing and other objects and in accordance with the purpose of the invention, a framing tool is provided that is adapted to apply fasteners to the interior perimeter of a frame. The framing tool includes a conventional driving means for propelling a fastener into the frame and a conventional storage means for storing a plurality of fasteners and delivering the fasteners to the driving means. The improvement of the present invention includes an actuator assembly having a rod that communicates with the driving means and a sleeve that is slidably coupled to the rod. A backing plate which is adapted to engage the exterior perimeter of the frame is secured to the sleeve at a selectable longitudinal position by a clamping means. By maintaining the position of the clamping means and thus the backing plate, the distance between the driving means and the inner perimeter of the frame can be held constant as fasteners are applied about the inner perimeter of the frame, thus insuring a consistent depth of fastener penetration. A trigger means is provided that moves the rod relative to the sleeve in order to cause the driving means to drive a fastener into the interior perimeter of the frame.

Preferably, the trigger means is hand operable and includes a handle securely mounted to the sleeve. A lever arm is hinged to the handle and securely attached the rod such that when the lever arm is drawn towards the handle, it translates the rod relative to the sleeve thereby actuating the driving means which propels a fastener into the frame.

BRIEF DESCRIPTION OF THE DRAWINGS

The features of the present invention that are believed to be novel are set forth with particularity in the appended claims. The invention, together with further objects and advantages thereof, may best be understood by reference to the following description taken in conjunction with the accompanying drawings in which:

DETAILED DESCRIPTION OF ILLUSTRATIVE EMBODIMENTS

Figure 1:
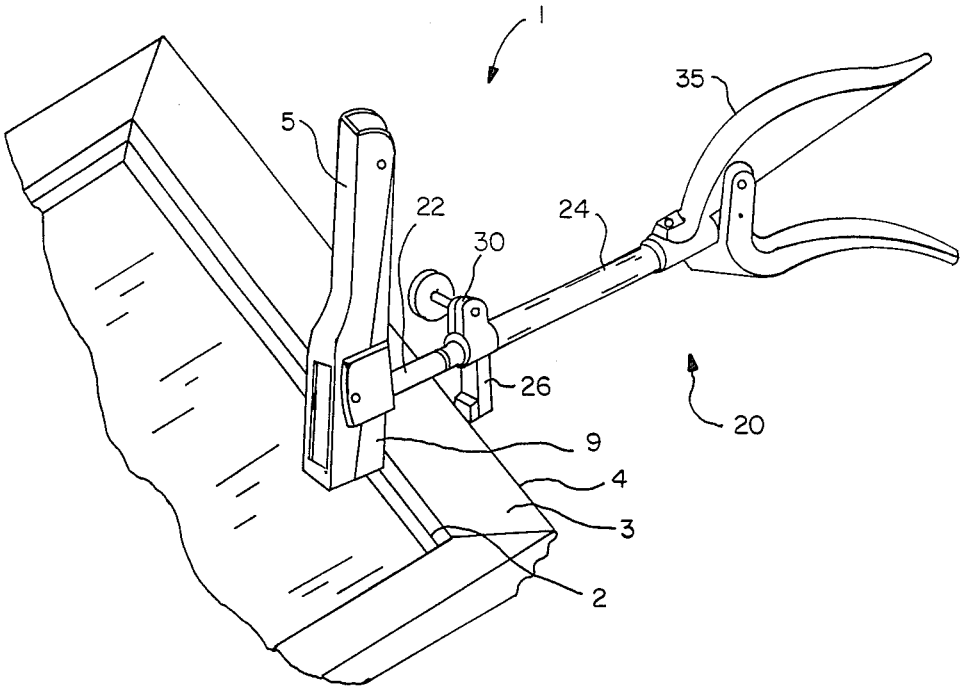
FIG. 1 is a perspective view of a picture framing tool featuring a stapler type fastener driving mechanism that incorporate the teachings of the present invention.

As illustrated in the drawings, the framing tool 1 of the present invention is adapted to apply fasteners to the interior perimeter of a standard picture frame 3. The framing tool 3 includes a driving means 5 for propelling a fastener 7 into the frame 2 and a storage means 9 for storing a plurality of fasteners 7 and delivering the fasteners to the driving means 5. The improvement of the present invention includes an actuator assembly 20 for positioning and triggering the driving means 5 such that the framing tool 3 consistently delivers fasteners 7 to a desired depth. The actuator assembly 20 includes a rod 22 in communication with the driving means 5 and a sleeve 24 slideably coupled to rod 22. A backing plate 26 adapted for engaging the exterior perimeter of frame 3 is secured to the sleeve 24 by a clamping means 30 which allows the backing plate 26 to be selectively positioned along the longitudinal axis of the sleeve. A hand operable trigger means 35 moves rod 22 relative to sleeve 24 in order to cause the driving means 5 to propel a fastener 7 into the interior perimeter of the frame.

Figure 2:
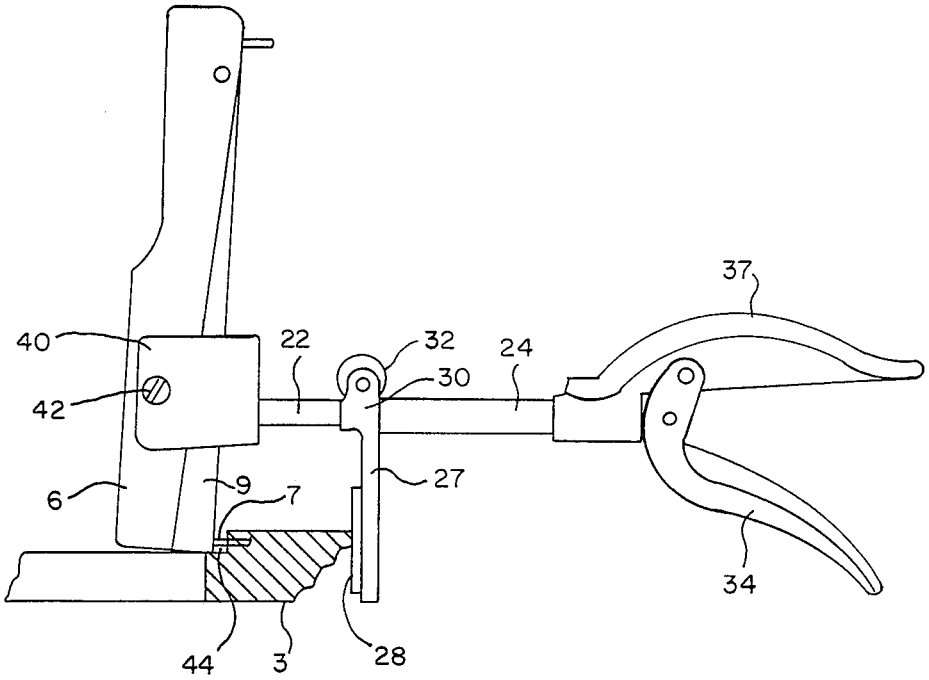
FIG. 2 is a side elevational view of the picture framing tool shown in FIG. 1.

Referring first to FIGS. 1 and 2, a preferred embodiment of the framing tool 1 that is particularly adapted for framing pictures, photos and the like will be described. In this embodiment, the driving means 5 takes the form of a standard stapler assembly which includes a fastener applying arm 6 that is pivotally mounted to a magazine arm 9 that constitutes the storage means. The fastener applying arm 6 includes a strike plate (not shown) that impacts a single U-shape staple adapted to straddle the magazine arm 9. When the fastener applying arm 6 is depressed, the strike plate impacts a staple 7 thereby driving the staple 7 into the picture frame 3. An actuator assembly 20 is adapted to both position the stapler assembly 5 and depress the fastener applying arm 6.

The actuator assembly 20 includes a rod 22 that is attached to the fastener applying arm 6 of stapler assembly 5 by bracket 40. The actual connection between bracket 40 and arm 6 may be made by any traditional attaching mechanism such as the screw 42 used in the displayed embodiment. It may be desirable to use two attaching mechanisms 42 on each side of the fastener to ensure a solid attachment. A sleeve 24 is journaled coaxially about rod 22 and is adapted for slideable motion thereover. A backplate 26 is slideably coupled to sleeve 24 and adapted to engage the external perimeter 4 of the frame 3 that is being mounted. A tubular clamping arrangement 30 that has a split-ring configuration is journaled about sleeve 24 and backplate 26 extends therefrom. The backplate 26 includes an arm 27 that carries a pad 28 adapted to abut against the frame 3. Pad 28 is preferably formed of a material that is non-abrasive to wood such as rubber. A thumb screw 32 allows the user to tighten and loosen clamp 30 about sleeve 24. When thumb screw 32 is loosened, slideable clamp 30 may be freely moved longitudinally along sleeve 24. However, when thumb screw 32 is tightened, backplate 26 is firmly secured to sleeve 24. Thus, the user may selectively position backplate 26 anywhere along the length of sleeve 9. In normal operation, the position of backplate 26 is adjusted so that when pad 28 contacts the outer perimeter 4 of frame 3, the magazine arm 9 of stapler assembly 5 is slightly spaced apart from the inner perimeter 2 of frame 3. Spaced apart distance 44 will dictate the height the staples will extend above the frame to hold a picture backing in place.

A compressible depth gauging device (not shown) may be provided to guide the users selection of the spaced apart distance 44 and thus the staple height. By way of example, a piece of flexible rubber or spring arrangement could be secured to the magazine arm 9 such that when untouched, the depth gauging device rests a selective distance in front of magazine arm 9 which may be used to position the backplate 26 to cause a desired depth of fastener penetration.

A trigger means 35 is provided to move rod 22 relative to sleeve 24. The trigger means includes a handle 37 secured to the distal extremity of sleeve 24. The lever arm 39 is hinged to handle 37 and coupled with the distal extremity of rod 22. Hinge 38 is positioned such that when lever arm 39 is depressed drawing it closer to handle 37, rod 22 is pulled outward relative to sleeve 24. Since backplate 26 prevents sleeve 24 from moving, the actuation of triggering means 35 by depressing lever arm 37 causes rod 22 to pull the fastener-applying arm 6 of stapler assembly 5. Magazine arm 9 of stapler assembly 5 is drawn to abut against the interior perimeter 2 of frame 3 and then further movement of rod 22 causes the fastener applying arm 6 to descend upon magazine arm 9 thereby driving a staple into the inner perimeter 2 of frame 3.

Figure 3:
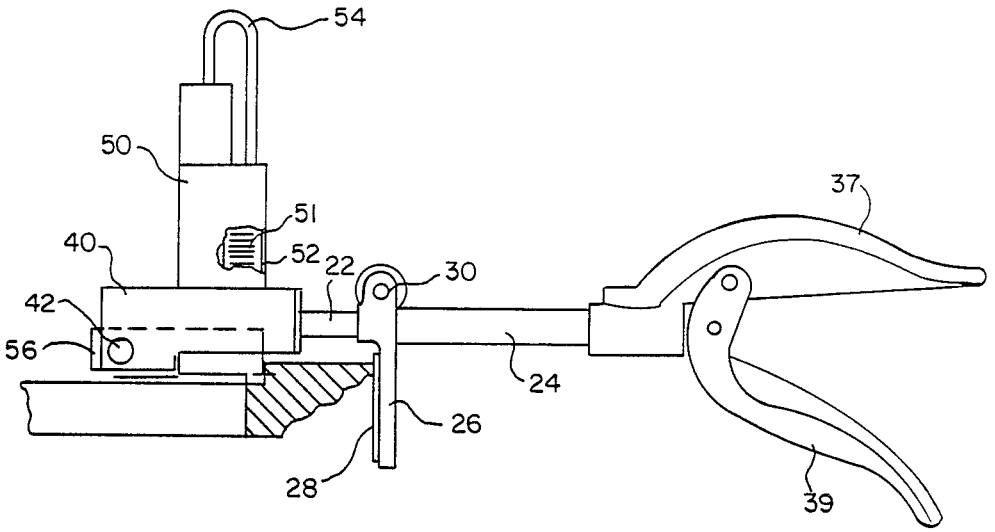
FIG. 3 is a side elevational view of an alternative embodiment of the picture framing tool incorporating a glazier point setter as the fastener driving mechanism.

An alternative embodiment of the present invention adapted to drive glazier points is shown in FIG. 3. The actuator assembly is identical to the actuator assembly described with respect to FIGS. 1 and 2. By way of example, a glazier's point driver as described by Hubbard et al. in U.S. Pat. No. 1,744,700 could be modified to work in accordance with the present invention. Specifically the glazier point driver may include a frame 50 having a magazine passage 52 adapted to hold the plurality of glazier points. A spring loaded U-shaped member 54 is adapted to force down on glazier points 51 located within magazine passage 52. A driving arm 56 includes a strike plate (not shown) that pushes a single glazier point 51 from the bottom of the stack into a frame when the glazier point driver 56 is activated. In this embodiment, a bracket 40 connects actuator assembly 20 to the glazier's point driver 56 in the same manner as described in relation to the stapler in FIGS. 1 and 2. Thus, depressing lever arm 39 in trigger means 35 causes glazier point driver 56 to move forward thereby pushing a glazier point 51 into the interior perimeter 2 of frame 3. It will be appreciated, that like the previously described embodiment, back plate 26 may be selectively positioned to control the depth to which the glazier's points are driven.

Figure 4:
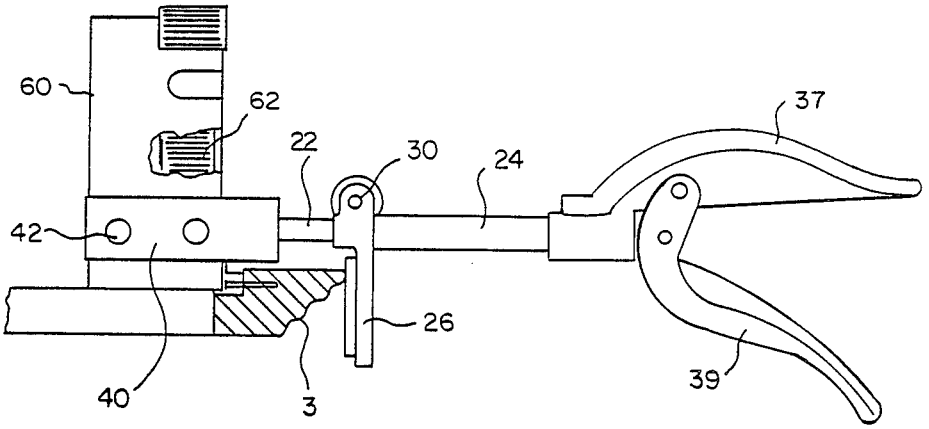
FIG. 4 is a side view of another embodiment of the present invention that incorporates a brad driving device as the fastener driving mechanism.

As may be appreciated by reference to FIG. 4, the actuator assembly could be adapted to work with the brad driving device 60 as well. Thus, instead of driving glazier points or staples, brads 62 could be used. It will also be appreciated that the backing plate 26 may include two contact pads instead of a single pad 28 in order to provide a more stable base. Although multiple contact pads could be used on any of the embodiments described, it is particularly helpful for stabilizing brad driving devices.

Although only a few embodiments of the present invention have been described, it should be understood that the present invention may be embodied in many other specific forms without departing from the spirit or scope of the invention. Particularly, it should be understood that the actuator assembly of the present invention could be adapted to actuate virtually any existing fastener driving instrument. Additionally, it will be apparent to those skilled in the art that rod 22 and sleeve 24 need not be coaxial but rather that they may be joined in any arrangement so long as they are slideably coupled. Thus, by way of example, rod 22 could be journaled about sleeve 21. Alternatively they could be slideably coupled adjacent each other. Further, there are numerous conceivable triggering means and backplate arrangements which could be used to accomplish the same function as the disclosed structures. Additionally, for particular applications such as brad driving, a guiding ridge could be provided that extends longitudinally along sleeve 24 in order to ensure that slideable clamp 30 does not swing freely about sleeve 24. Therefore, the present examples of embodiments are to be considered illustrative and not restrictive, and the invention is not to be limited to the details given herein, but may be modified within the scope of the appended claims.

I claim:

1. A framing tool for applying fasteners to the perimeter of a frame having opposing interior and exterior perimeters comprising:

driving means for pressing fasteners into a first perimeter of the frame;

storage means for holding a multiplicity of fasteners and sequentially delivering fasteners to the driving means after each fastener driving operation;

depth setting means for allowing an operator to selectively adjust the depth of fastener penetration, the depth setting means including a backing plate for engaging a second perimeter of said frame to limit the depth of fastener penetration, said second perimeter opposing said first perimeter;

triggering means for actuating said driving means to apply a fastener to the frame, the triggering means being hand operable and including a pair of opposed levers pivotally connected together whereby the driving means is actuated by pressing the pivotally mounted levers together.

2. A framing tool adapted to apply fasteners to a frame having interior and exterior perimeters, comprising:

a driving means for driving the fasteners into the frame;

a storage means for storing a plurality of the fasteners and delivering said fasteners to the driving means;

a rod in communication with the driving means;

a sleeve slideably coupled to the rod;

a backing plate for engaging the exterior perimeter of the frame to position the driving means relative to the interior perimeter of the frame;

a clamp for securing the backing plate to the sleeve at selectable longitudinal positions along the sleeve, the clamp having a tubular portion journaled about the sleeve and a tightening means for selectively securing the backing plate at a selected position along the sleeve;

a handle securely mounted to the sleeve, whereby the handle limits the travel to the tubular member along the sleeve in a first direction;

a lever arm hinged to the handle and securely attached to the rod such that drawing the lever arm towards the handle causes the rod to move relative to the sleeve and thereby activate the driving means.

3. In a framing tool adapted to apply fasteners to a frame having interior and exterior perimeters, the framing tool including an actuator driving means for driving a fastener into the frame, and a storage means for storing a plurality of the fasteners and sequentially delivering said fasteners to the driving means, the improvement being an actuator assembly comprising:

a rod in communication with the driving means;

a sleeve slideably coupled to the rod;

a backing plate for engaging the exterior perimeter of the frame to position the driving means relative to the interior perimeter of the frame the backing plate cooperating with the sleeve and rod and driving means to limit the depth the fastener penetrates the frame;

clamping means for securing the backing plate to the sleeve at selectable longitudinal positions along the sleeve to facilitate fastener depth adjustment and use with variable sized frames; and trigger means for moving the rod relative to the sleeve to cause the driving means to drive a fastener into the interior perimeter of the frame, said trigger means being hand operable.

4. A framing tool as recited in claim 3 wherein said rod and said sleeve are mounted coaxially.

5. A framing tool as recited in claim 4 wherein said clamping means includes a tubular member journaled about said sleeve, and a clamp member for tightening the tubular member about the sleeve, whereby said tubular member is sized and shaped so it is free to travel longitudinally along the sleeve when the clamp member is not tightened.

6. A framing tool as recited in claim 3 wherein said trigger means includes a handle securely mounted to a first end of the sleeve.

7. A framing tool as recited in claim 6 wherein said trigger means further includes a lever arm hinged to the handle and securely attached to a first end of the rod, whereby when said lever arm is drawn towards the handle, it moves the rod relative to the sleeve.

8. A framing tool as recited in claim 3 wherein the driving means is adapted to deliver staple fasteners.

9. A framing tool as recited in claim 3 wherein the driving means is adapted to deliver glazier point fasteners.

10. A framing tool as recited in claim 3 wherein the driving means is adapted to deliver brad fasteners.

11. A framing tool as recited in claim 3 wherein said backing plate includes a pad adapted to engage the frame and formed of a non-abrasive material.

* * * * *